US005809946A

United States Patent [19]

Abe

[11] Patent Number: 5,809,946

[45] Date of Patent: Sep. 22, 1998

[54] STRUCTURE OF AN OPEN DECK TYPE CYLINDER BLOCK

[75] Inventor: Kazuyoshi Abe, Susono, Japan

[73] Assignee: Toyota Jidosha Kabushiki Kaisha, Toyota, Japan

[21] Appl. No.: 897,932

[22] Filed: Jul. 21, 1997

[30] Foreign Application Priority Data

Aug. 1, 1996 [JP] Japan ..... 8-203766

[51] Int. Cl.[6] ..... F02F 1/00

[52] U.S. Cl. ..... 123/41.74; 123/193.3

[58] Field of Search ..... 123/41.47, 193.1, 123/193.2, 193.3

[56] References Cited

U.S. PATENT DOCUMENTS

| | | | |
|---|---|---|---|
| 4,394,850 | 7/1983 | Hayashi | 123/41.74 |
| 4,686,943 | 8/1987 | Anno et al. | 123/41.74 |
| 4,712,517 | 12/1987 | Anno et al. | 123/41.74 |

FOREIGN PATENT DOCUMENTS

| | | |
|---|---|---|
| 6-213064A | 8/1994 | Japan . |
| 6-218560A | 8/1994 | Japan . |
| 7-4304 A | 1/1995 | Japan . |

*Primary Examiner*—Weilun Lo
*Attorney, Agent, or Firm*—Kenyon & Kenyon

[57] ABSTRACT

To prevent deformation, in the upper portions of cylinder bores, that occurs when the cylinder head is mounted on the cylinder block by using head bolts and to prevent deformation in the upper portions of the cylinder bores caused by the thermal expansion of the cylinder head. In an open deck type cylinder block of an internal combustion engine in which the cylinder bores are separated from the outer shell of the cylinder block by water jackets in the upper deck, thick portions are formed near the ends of the cylinder bores located at both ends of the internal combustion engine in the direction of the crank shaft, the end portions being opposed to the outer shell of the cylinder block in the axial direction of the crank shaft, the thick portions being smoothly continuous with the outer shell of the initial cylinder bores. The thick portions have the greatest thickness at the ends in the direction of the crank shaft. A decreased-diameter portion having a thickness smaller than that of the upper portions is formed in the lower portions of the cylinder bores neighboring the regions where the thick portions are formed, and the decreased-diameter portion and the ordinary cylinder bores of the upper portions thereof are connected together through the tapered portion to decrease the weight of the cylinder block.

6 Claims, 7 Drawing Sheets

PRIOR ART

PRIOR ART

PRIOR ART

STRUCTURE OF AN OPEN DECK TYPE CYLINDER BLOCK

BACKGROUND OF THE INVENTION

1. Field of the Invention

The present invention relates to the structure of an open deck type cylinder block of a multi-cylinder internal combustion engine. More particularly, the invention relates to the structure of an open deck type cylinder block which prevents thermal deformation of the cylinder bores located at both ends of the cylinder block in the direction of the crank shaft and prevents deformation of the cylinder bores when a cylinder head is mounted on the cylinder block using head bolts.

2. Description of the Related Art

In order to improve cooling efficiency of the cylinder block of an internal combustion engine and to decrease the weight of the cylinder block, in recent years, an open deck type cylinder block of a double structure has been put into practical use according to which the cylinder bores and the outer shell of the cylinder block are separated away from each other by a water jacket that is interposed therebetween at an upper portion thereof. A cylinder head is mounted on this open deck type cylinder block with a gasket being interposed therebetween, and is fastened to head bolt bosses formed in the outer shell of the cylinder block by using head bolts.

In the open deck type cylinder block, the cylinder bores and the outer shell of the cylinder block are separated away from each other by the water jacket in the upper deck. The upper deck of the cylinder block is provided with head bolt holes for the head bolts for mounting the cylinder head and with oil return holes.

In the thus constituted open deck type cylinder block, the expanding force of the cylinder head is greater than that of the cylinder block when the engine is in operation, and the cylinder block is thermally deformed due to the cylinder head. That is, the expanding force of the cylinder head acts upon the cylinder bores, and the upper portions of the cylinder bores are deformed in the direction of the crank shaft. The thermal deformation becomes great particularly in the first cylinder #1 and in the fourth cylinder #4 located at both ends, resulting in an increase in the consumption of oil and an increase in friction.

In the conventional open deck type cylinder block, furthermore, the cylinder bores have the same thickness from the upper part to the lower part thereof or have a thickness which increases toward the lower side. When the cylinder head is mounted or the engine is in operation, therefore, the upper portions of the cylinder bores tend to be deformed in a flaring manner in the thrust direction and in the counter-thrust direction.

In order to solve the problem in that the upper portions of the cylinder bores of the cylinders (first cylinder #1 and fourth cylinder #4) at both ends undergo a deformation when the cylinder head is mounted on the open deck type cylinder block or when the engine is in operation, therefore, it has been proposed to couple the upper end of the cylinder bores of only those cylinders located at both ends of the cylinder head to the upper end of the outer shell of the cylinder block (see Japanese Unexamined Patent Publication (Kokai) No. 7-4304).

According to the technology disclosed in Japanese Unexamined Patent Publication No. 7-4304 in which the cylinder block is coupled to the upper end of the cylinder bores, however, force acts on four corners of the cylinder block in the direction of cylinder bores when the cylinder head is mounted on the cylinder block. This force also acts on the cylinder bores which, therefore, undergo deformation.

SUMMARY OF THE INVENTION

A first object of the present invention is to provide a structure of the open deck type cylinder block which prevents the upper portions of the cylinder bores from being deformed by the thermal expansion of the cylinder head when the engine is in operation, and prevents the upper portions of the cylinder bores from being deformed even when the cylinder head is mounted on the cylinder block by using head bolts.

A second object of the present invention is to decrease the weight of the cylinder block while accomplishing the first object.

In order to accomplish the first object according to the present invention, there is provided an open deck type cylinder block of an internal combustion engine in which the cylinder bores and the outer shell of the cylinder block are separated away from each other at upper portions thereof, wherein the cylinder bores located at both ends of the internal combustion engine in the direction of the crank shaft have end portions thicker than other portions, said end portions being opposed to the outer shell of the cylinder block in the direction of the crank shaft.

In order to accomplish the second object according to the present invention, furthermore, the lower portions of the cylinder bores, except the portions thicker than other portions of the cylinder bores, are thinner than the upper portions thereof.

According to the open deck type cylinder block of the present invention, the free ends of the cylinder bores at both ends have an increased thickness and have an increased strength, and stop the cylinder head from being thermally deformed when the engine is in operation. Besides, since the cylinder bores are not coupled to the outer shell of the cylinder head, the cylinder bores are little deformed even after fastening by the head bolts. Moreover, the weight of the cylinder block can be decreased when the thickness of the lower portions of the cylinder bores are decreased except at the thickened portions of the cylinder bores.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Before describing the preferred embodiments, an explanation will be given of a conventional structure of the open deck type cylinder block shown in FIGS. 1A to 3B.

Figure 1A:
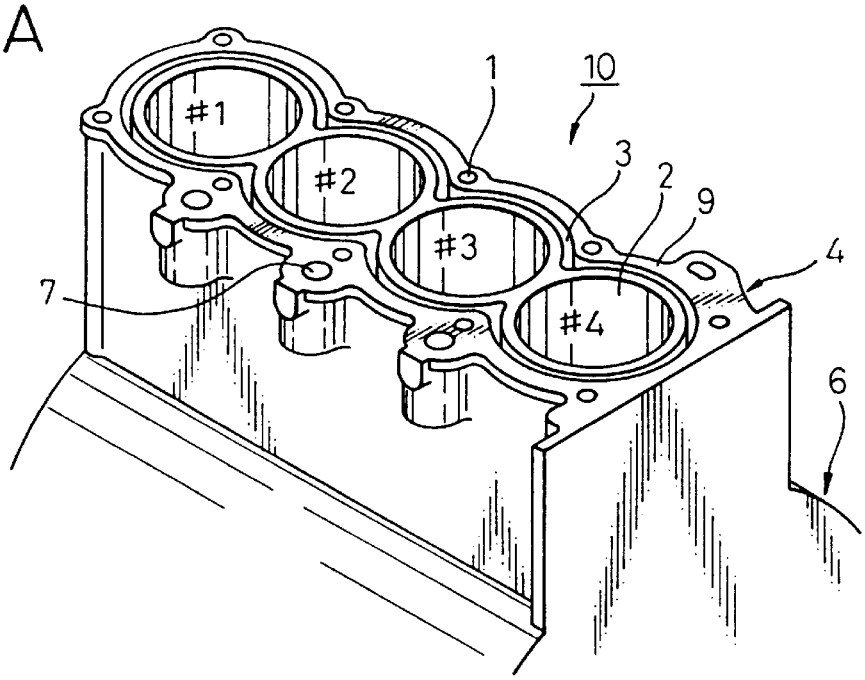
FIG. 1A is a perspective view illustrating the constitution of the upper deck of a conventional open deck type cylinder block.

FIG. 1A illustrates the constitution of the upper deck of a conventional open deck type cylinder block, i.e., illustrates an upper deck 4 which is an upper part of a cylinder block 10 of a four-cylinder internal combustion engine, and a portion of a lower deck 6 which is a lower part.

In the open deck type cylinder block 10, a water jacket 3 is formed between the cylinder bores 2 and the outer shell 9 of the cylinder block. In the upper deck 4, the cylinder bores 2 and the outer shell 9 of the cylinder block are separated away from each other by the water jacket 3. The cylinder block 10 of this embodiment is of the Siamese type in which the neighboring cylinder bores 2 are formed as a unitary structure. The upper deck 4 is further provided with head bolt holes for attaching the head bolts that are not shown and with oil return holes 7.

Figure 1B:
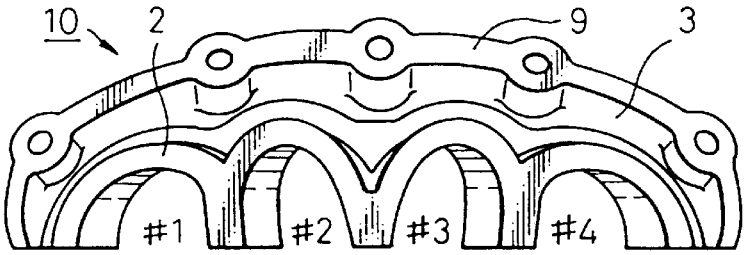
FIG. 1B is a diagram illustrating the thermally deformed state of the open deck type cylinder block of FIG. 1A.
Figure 1C:
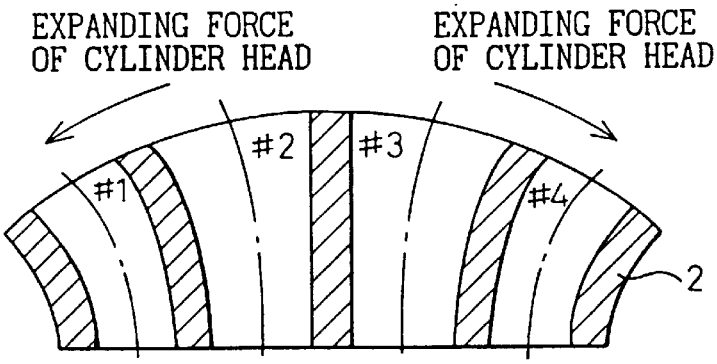
FIG. 1C is a sectional view of the cylinder bores of FIG. 1B in the direction of the crank shaft.

In the thus constituted conventional open deck type cylinder block 10, the expanding force of the cylinder head is greater than that of the cylinder block when the engine is in operation, and the cylinder block 10 is thermally deformed by the cylinder head. FIGS. 1B and 1C illustrate the thermally deformed state of the cylinder block 10 of FIG. 1A. The expanding force of the cylinder head acts on the cylinder bores 2 as indicated by arrows in FIG. 1C, and the upper portions of the cylinder bores 2 are deformed in the direction of the crank shaft. The thermal deformation appears particularly in the first cylinder #1 and in the fourth cylinder #4 at both ends, often resulting in an increase in the consumption of oil and an increase in friction.

Figure 2A:
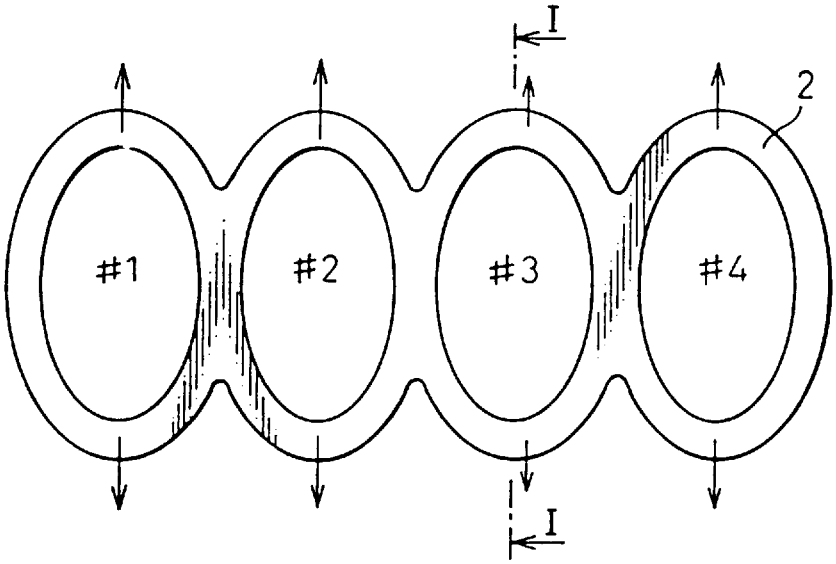
FIG. 2A is a diagram illustrating the deformation of top planes of the cylinder bores when the cylinder head is mounted or during combustion.
Figure 2B:
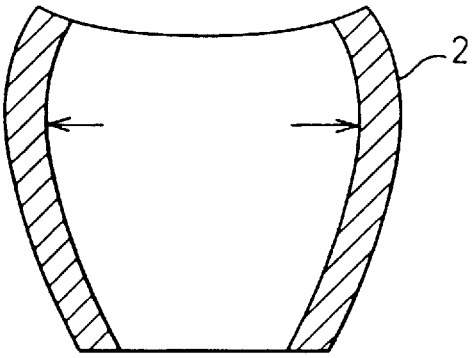
FIG. 2B is a sectional view along the line B—B of FIG. 2A.

In the conventional open deck type cylinder block 10, furthermore, the cylinder bores 2 have the same thickness from the upper portion thereof down to the lower portion thereof, or have a thickness which increases toward the lower portion thereof. When the cylinder head is mounted or when the engine is in operation, therefore, the upper portions of the cylinder bores 2 are deformed in a flaring manner in the thrust direction and in the counter-thrust direction as shown in FIGS. 2A and 2B (sectional view along the line B—B of FIG. 2A).

Figure 3A:
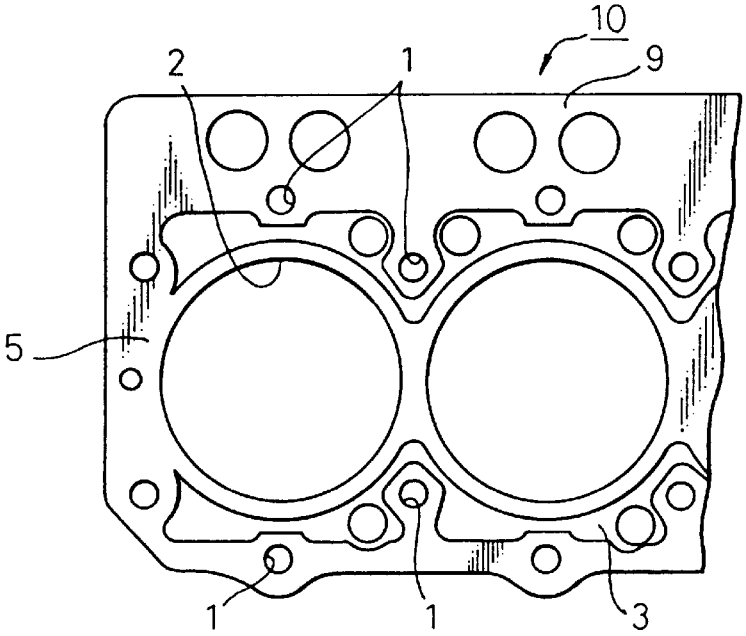
FIG. 3A is a plan view illustrating a portion of a conventional improved open deck type cylinder block.

In order to eliminate this problem, Japanese Unexamined Patent Publication No. 7-4304 discloses the open deck type cylinder block 10 in which, as shown in FIG. 3A, the upper end portions of the cylinder bores 2 at both ends of the cylinder block 10 are coupled to the upper end portions of the outer shell 9 of the cylinder block through a coupling portion 5.

According to the art disclosed in Japanese Unexamined Patent Publication No. 7-4304, however, a force acts on four corners of the cylinder block 10 in the direction of the cylinder bores 2 when the cylinder head is mounted on the cylinder block 10. When the cylinder block 10 and the upper end portions of the cylinder bores 2 are coupled together, therefore, this force also acts on the cylinder bores 2, eventually causing the cylinder bores 2 to be deformed, too.

Figure 3B:
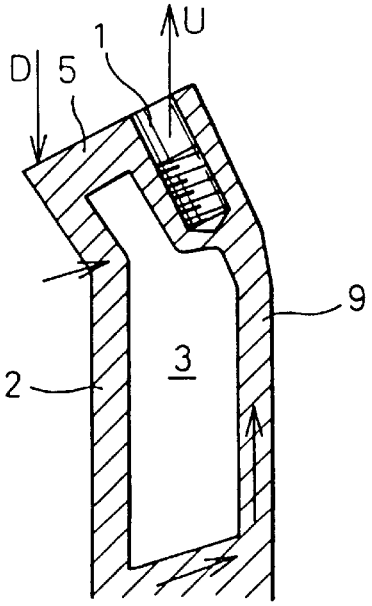
FIG. 3B is a sectional view of a portion for explaining the problem of the open deck type cylinder block of FIG. 3A.

FIG. 3B is a diagram for explaining this problem. Referring to FIG. 3B, when an axial force is produced as indicated by an arrow U by a head bolt screwed into a head bolt hole 1, the outer shell 9 of the cylinder block is tilted toward the cylinder bores 2 due to the axial force U. Then, the inclining force of the outer shell 9 of the cylinder block acts as indicated by an arrow D upon the upper portions of the cylinder bores 2 due to the coupling portion 5 coupling the outer shell 9 of the cylinder block to the upper end portions of the cylinder bores 2, causing the upper portions of the cylinder bores 2 to be bent.

Described below in detail is the structure of the open deck type cylinder block of the present invention for coping with such problems.

Figure 4A:
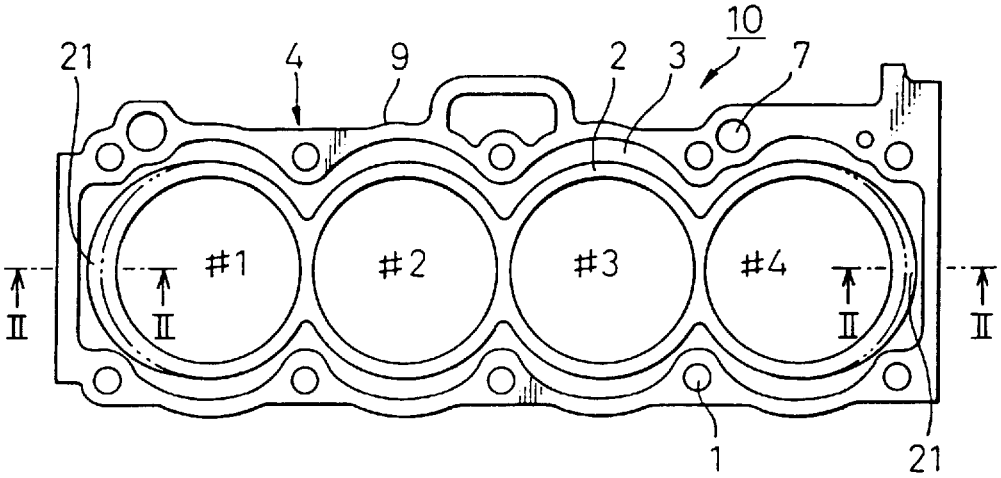
FIG. 4A is a plan view of the upper deck of the cylinder block illustrating the constitution of the open deck type cylinder block according to a first embodiment of the present invention.

FIG. 4A illustrates the structure of the open deck type cylinder block 10 according to a first embodiment of the present invention, and shows the upper deck 4 which is an upper part of the cylinder block 10 of a four-cylinder internal combustion engine.

In the open deck type cylinder block 10, a water jacket 3 is formed between the cylinder bores 2 and the outer shell 9 of the cylinder block, and the cylinder bores 2 are separated away from the outer shell 9 of the cylinder block in the upper deck 4. The cylinder block 10 of this embodiment is of the Siamese type in which the neighboring cylinder bores 2 are formed as a unitary structure. The upper deck 4 is provided with head bolt holes 1 for attaching the head bolts that are not shown and with oil return holes 7.

Figure 4B:
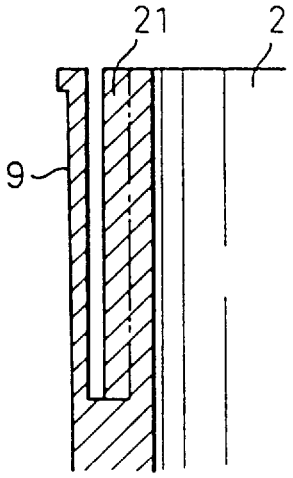
FIG. 4B is a sectional view along the line X—X of FIG. 4A.
Figure 4C:
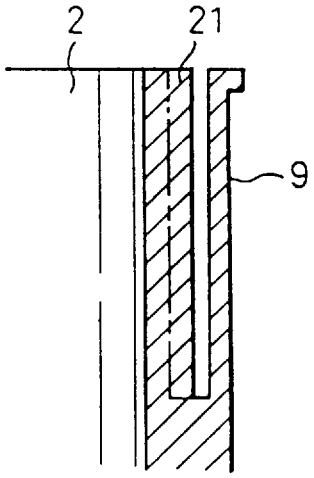
FIG. 4C is a sectional view along the line Y—Y of FIG. 4A.

In the first cylinder #1 and in the fourth cylinder #4 located at both ends in the direction of the crank shaft according to the first embodiment, the vicinities of the free ends of the cylinder bores 2 opposed to the outer shell 9 of the cylinder block in the direction of the crank shaft have a thickness, as designated at 21, which is greater than the thickness of other portions. In the first embodiment, the thick portions 21 are formed for the cylinder bores 2 at the regions on the outside of a line perpendicular to the crank shaft that passes through the centers of the cylinder bores 2 of the first cylinder #1 and the fourth cylinder #4, the thickness increasing toward the free ends of the cylinder bores 2 in the direction of the crank shaft. In the first embodiment, the thick portions 21 have the same thickness in the upper portions thereof and in the lower portions thereof as will be understood from FIG. 4B which is a sectional view along the line X—X of FIG. 4A and FIG. 4C which is a sectional view along the line Y—Y of FIG. 4A.

According to the first embodiment as described above, the thick portion 21 thicker than other portions is formed in the vicinities of the free ends of the cylinder bores 2. Even when the expanding force of the cylinder head acts upon the cylinder bores 2 during the operation of the engine as shown in FIG. 1C, therefore, the cylinder bores of the first cylinder #1 and the fourth cylinder #4 reinforced by the thick portions 21 is not deformed, and maintains its straightness.

That is, when the cylinder bores 2 of the first cylinder #1 and the fourth cylinder #4 are not provided with thick portions 21, a three-dimensional deformation takes place in which the shape tends to become a triangular shape due to the expansion in the direction perpendicular to the crank shaft and the expansion in the direction of the crank shaft, and the tracing performance of the piston rings is deteriorated. When the cylinder bores of the first cylinder #1 and the fourth cylinder #4 are provided with thick portions 21, on the other hand, the expansion in the direction of the crank shaft is suppressed by the outer shell of the cylinder bores 2 reinforced with the thick portions 21. Depending upon the expansion in the direction perpendicular to the crank shaft, therefore, the shape of the cylinder bores 2 is suppressed to be that of a two-dimensional deformation like an ellipse with the direction of the crank shaft as a short axis, whereby the tracing performance of the piston rings is improved and the friction decreases.

Since the deformation of the first and fourth cylinders is suppressed by the thick portions 21, the cylinder bores 2 are suppressed from deforming when the cylinder head is mounted. A decrease in the deformation of the cylinder bores contributes to decreasing the consumption of an oil, decreasing the friction, increasing the engine output and improving the fuel efficiency of the engine.

Figure 5A:
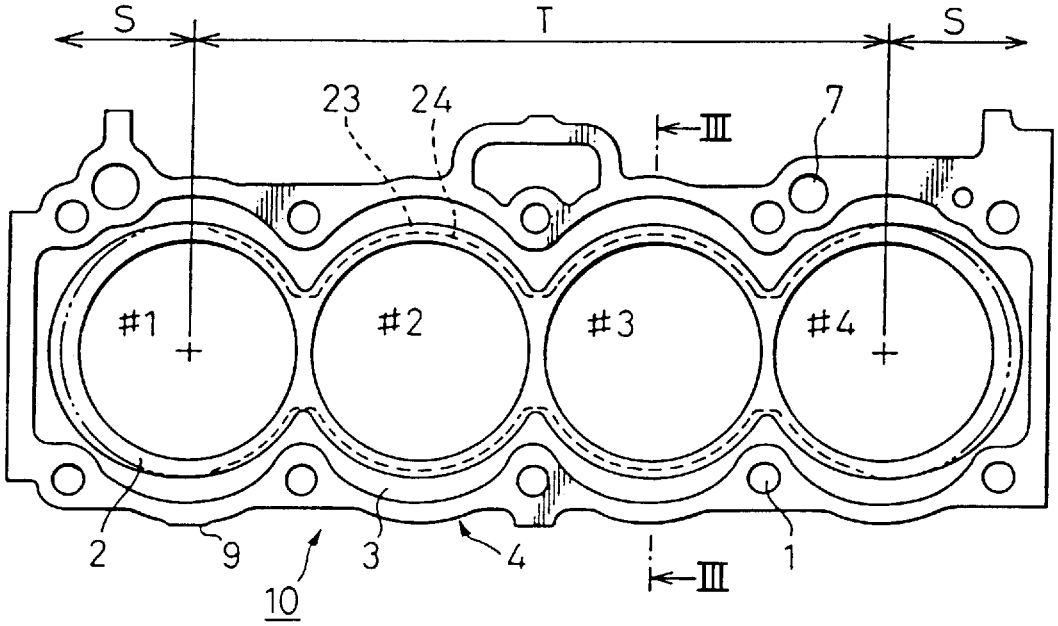
FIG. 5A is a plan view of the upper deck of the cylinder block illustrating the constitution of the open deck type cylinder block according to a second embodiment of the present invention.
Figure 5B:
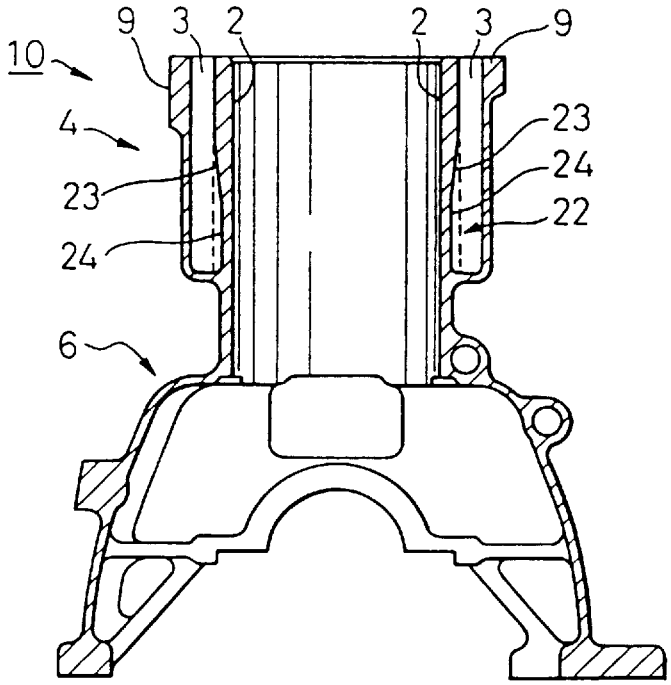
FIG. 5B is a sectional view along the line A—A of FIG. 5A.

FIG. 5A illustrates the constitution of the open deck type cylinder block 10 according to a second embodiment of the present invention, and shows the upper deck 4 which is the upper part of the cylinder block 10 of a four-cylinder internal combustion engine. FIG. 5B is a sectional view of the cylinder block along the line A—A of FIG. 5A.

Referring to FIGS. 5A and 5B, even in the open deck type cylinder block 10 of the second embodiment, the water jacket 3 is formed between the cylinder bore 2 and the outer shell 9 of the cylinder block, and the cylinder bores 2 are separated away from the outer shell 9 of the cylinder block in the upper deck 4 as in the first embodiment. The cylinder block 10 of the second embodiment is of the Siamese type, too, in which the neighboring cylinder bores 2 are formed as a unitary structure. The upper deck 4 is provided with head bolt holes 1 for attaching the head bolts that are not shown and with the oil return holes 7.

In the first embodiment, thick portions 21 thicker than other portions are formed on the sides of free ends of the cylinder bores 2 of the first cylinder #1 and the fourth cylinder #4 located at both ends in the direction of the crank shaft. In the first embodiment, furthermore, the thick portions 21 are formed for the cylinder bores 2 of regions S on the outer side of a line perpendicular to the crank shaft that passes through the centers of the cylinder bores 2 of the first cylinder #1 and the fourth cylinder #4, and become thicker toward the ends of the cylinder bores 2.

The second embodiment is also provided with the thick portions 21 of the first embodiment. In the second embodiment, furthermore, the thickness of the lower portions of the cylinder bores 2 is decreased in the regions T, except the regions S where the thick portions 21 are formed, to thereby form a tapered portion 23 and a decreased-diameter portion 24 as shown in FIG. 5B.

Figure 6:
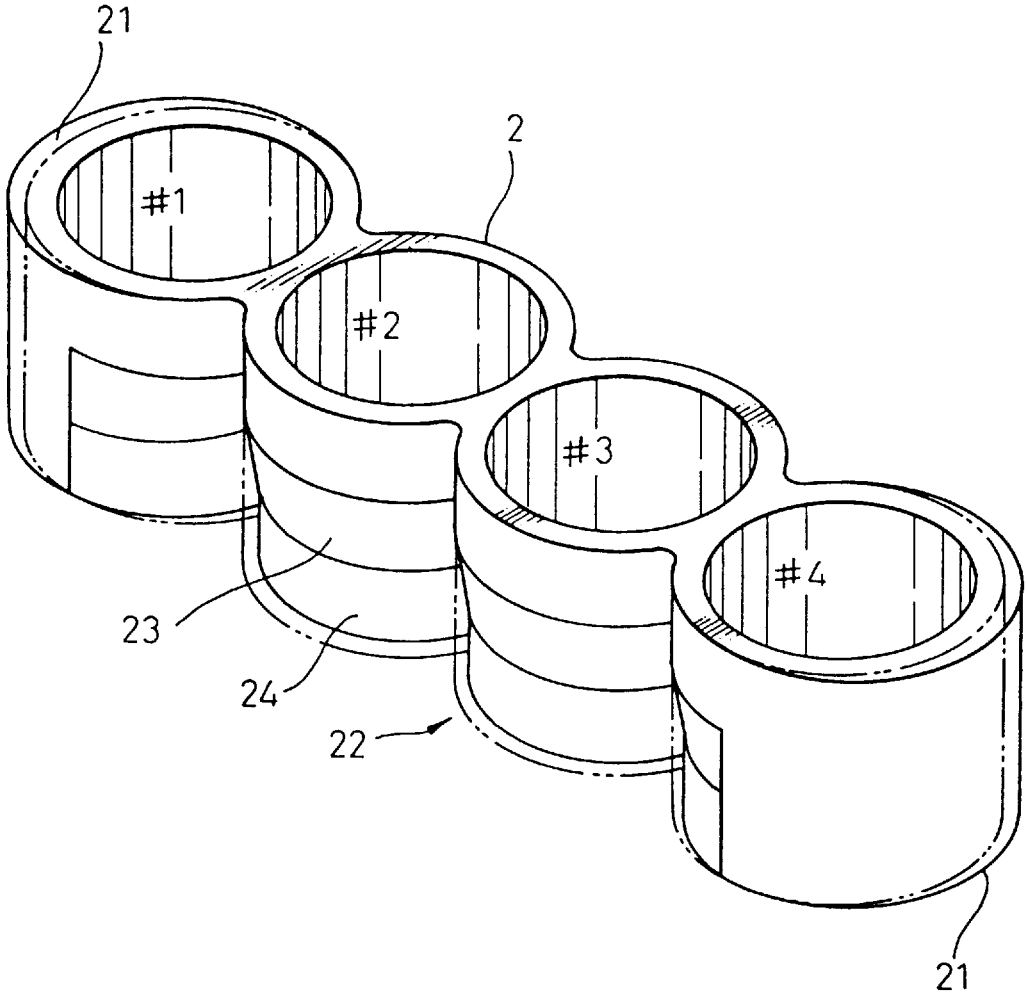
FIG. 6 is a perspective view illustrating the constitution of only the portions of the cylinder bores of FIGS. 5A and 5B surrounded by the water jackets.

FIG. 6 illustrates only the portions of the cylinder bores 2 of FIG. 5A surrounded by the water jackets 3 to clearly illustrate the constitution of the thick portions 21, tapered portion 23 and the decreased-diameter portion 24.

According to the second embodiment, as will be obvious from FIG. 6, thick portions 21 are formed at both ends of the cylinder bores 2 of the first cylinder #1 and the fourth cylinder #4 in the direction of the crank shaft, the thick portions 21 becoming thicker toward the ends of the cylinder bores 2 and are smoothly continuous with the initial outer shell surface of the cylinder bores 2 as in the first embodiment. Furthermore, a decreased-diameter portion 24 having a decreased thickness is formed in the lower portions 22 of the cylinder bores of the first to fourth cylinders in the regions other than the regions where the thick portions 21 are formed, and is smoothly connected, through the tapered portion 23, to the initial outer shell surface of the cylinder bores 2.

Figure 7:
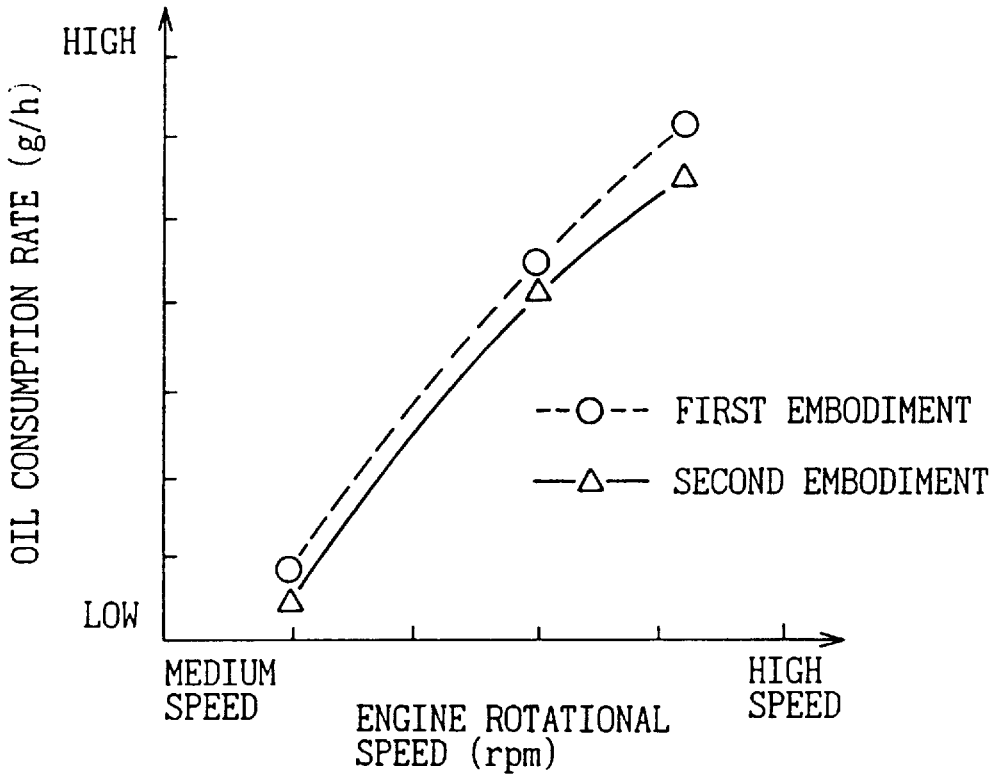
FIG. 7 is a diagram of characteristics showing the oil consumption rate versus the rotational speed of the engine using the open deck type cylinder blocks of the first and second embodiments of the present invention.

The thickness of the lower portions of the cylinder bores 2 is decreased for the reasons described below. That is, when the cylinder head is mounted or the engine is in operation as explained with reference to FIG. 1C, the upper portions of the cylinder bores 2 are deformed in a flaring manner in the open deck type cylinder block 10, but the lower portions of the cylinder bores 2 are hardly deformed. Even when the thickness is decreased at the lower portions of the cylinder bores 2, the degree of deformation of the cylinder bores 2 almost does not change. In order to make sure of this fact, the rate of oil consumption was measured with respect to the rotational speed of the engine by using the open deck type cylinder blocks 10 of the first embodiment and the second embodiment. FIG. 7 illustrates the measured results. As will be understood from FIG. 7, there is almost no change in the rate of oil consumption between the open deck type cylinder block 10 of the first embodiment and the open deck type cylinder block 10 of the second embodiment, and the degree of deformation of the cylinder bores 2 does not increase even when the thickness is decreased in the lower portions of the cylinder bores 2.

When the thickness of the cylinder bores 2 is uniformly decreased from the upper portions down to the lower portions, the bores are deformed in large amounts, oil is consumed in an increased amount and friction increases.

When the thick portions 21 are formed at both end portions of the cylinder bores 2 in a manner to be continuous to the outer shell, and when the tapered portion 23 and the decreased-diameter portion 24 are formed in the lower portions 22 of the cylinder bores 2 of the first to fourth cylinders in the regions other than the regions where the thick portions 21 are formed according to the second embodiment, it is possible to decrease the weight of the cylinder block 10 in addition to obtaining the effect of the first embodiment.

In the case of a four-cylinder internal combustion engine, a decrease in the weight of the cylinder block 10 is about 500 g when the cylinder bores 2 have a uniform thickness of about 7 mm and the thickness of the cylinder bores 2 is decreased by about 3 mm in the lower portions thereof.

According to the present invention, as described above, the thick portions formed for the cylinder bores make it possible to prevent the upper portions of the cylinder bores from being deformed by the thermal expansion of the cylinder head when the engine is in operation, and to prevent the upper portions of the cylinder bores from being deformed when the cylinder head is mounted on the cylinder block by using head bolts.

Furthermore, when the thickness is decreased in the lower portions except the portions where the thick portions are formed for the cylinder bores, it is possible to decrease the weight of the cylinder block.

What is claimed is:

1. An open deck type cylinder block of an internal combustion engine in which a water jacket is formed between the cylinder bores and the outer shell of the cylinder block, and the cylinder bores are separated from the outer shell of the cylinder block in the upper deck, wherein thick portions thicker than other portions are formed near the ends of the cylinder bores located at both ends of the internal combustion engine in the direction of the crank shaft, said ends being opposed to the outer shell of the cylinder block in the direction of the crank shaft.

2. An open deck type cylinder block structure according to claim 1, wherein said thick portions are formed for the cylinder bores in regions on both sides of a line perpendicular to the crank shaft that passes through the centers of the cylinder bores of the cylinders located at both ends of the internal combustion engine, the thickness of said thick portions increasing toward the free ends of the cylinder bores in the direction of the crank shaft.

3. An open deck type cylinder block structure according to claim 2, wherein said thick portions have a thickness which remains the same even in the upper portions thereof or in the lower portions thereof in the direction of height of the cylinder bores.

4. An open deck type cylinder block structure according to claim 1, wherein a decreased-diameter portion having a thickness smaller than that of the upper portions is formed in the lower portions of the cylinder bores neighboring the regions where said thick portions are formed.

5. An open deck type cylinder block structure according to claim 4, wherein a tapered portion is formed between said decreased-diameter portion and the ordinary cylinder bores of the upper portions thereof to smoothly connect their outer surfaces together.

6. An open deck type cylinder block structure according to claim 1, wherein said thick portions are formed for the cylinder bores in regions on both sides of a line perpendicular to the crank shaft that passes through the centers of the cylinder bores of the cylinders located at both ends of the internal combustion engine, the thickness of said thick portions being uniform in the direction of height of the cylinder bores and increasing toward the free ends of the cylinder bores in the direction of the crank shaft, a decreased-diameter portion having a thickness smaller than that of the upper portions is formed in the lower portions of the cylinder bores neighboring the regions where said thick portions are formed, and a tapered portion is formed between said decreased-diameter portion and the ordinary cylinder bores of the upper portions thereof to smoothly connect their outer surfaces together.

* * * * *